US006453888B1

(12) United States Patent
Ueda et al.

(10) Patent No.: US 6,453,888 B1
(45) Date of Patent: Sep. 24, 2002

(54) ENGINE FUEL SUPPLY SYSTEM

(75) Inventors: Minoru Ueda; Kenichiro Ikeda, both of Saitama (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 14 days.

(21) Appl. No.: 09/702,901

(22) Filed: Nov. 1, 2000

(30) Foreign Application Priority Data

Nov. 1, 1999 (JP) ..... 11-311469

(51) Int. Cl.[7] ..... F02M 23/00; F02M 29/00
(52) U.S. Cl. ..... 123/531; 123/590
(58) Field of Search ..... 123/531, 533, 123/525, 527, 590, 179.16, 179.17

(56) References Cited

U.S. PATENT DOCUMENTS 4,353,345 A * 10/1982 Ebihara ..... 123/575
4,991,561 A * 2/1991 Gerassimov et al. ..... 123/527
5,887,574 A * 3/1999 Smith ..... 123/527
5,908,475 A * 6/1999 Morris, Jr. et al. ..... 123/525

FOREIGN PATENT DOCUMENTS

JP A526132 2/1993

* cited by examiner

*Primary Examiner*—Willis R. Wolfe
*Assistant Examiner*—Mahmoud Gimie
(74) *Attorney, Agent, or Firm*—Birch, Stewart, Kolasch & Birch, LLP

(57) ABSTRACT

An intake path organizer forms an intake path communicating with an air cleaner. The intake path organizer has a fuel passage for guiding fuel from a fuel injection valve fitted into the intake path organizer, at least one fuel induction port having one end communicating with the fuel passage and the other end communicating with the intake path, and an air bleed passageway having one end communicating with the intake path further upstream than the fuel induction port and the other end communicating with the fuel passageway, all of the elements being provided in the intake path organizer to promote atomization of fuel in an engine fuel supply system. The fuel induction ports can open to the intake path in a direction orthogonal to the airflow in the intake path.

18 Claims, 9 Drawing Sheets

ENGINE FUEL SUPPLY SYSTEM

BACKGROUND OF THE INVENTION

1. Field of the Invention

The present invention relates to an engine fuel supply system, particularly to a fuel supply system having a fuel injection valve fitted in an intake path. The present invention utilizes a fuel supply system having an intake path organizer to promote more reliable and efficient fuel atomization.

2. Background Art

A fuel supply system of the background art is shown in Japanese Patent Laid-open No. Hei. 5-26132. This system utilizes a compressed air pump that works as a pump when the negative pressure in an intake route nearer to the engine side than the throttle valve does not exceed a predetermined level. When a throttle valve is driven in a low opening region, an OFF signal from a pressure sensor is output to the compressed air pump so that compressed air is not supplied to a second air route.

However, with the fuel supply systems of the related art, the fuel induction port opens facing a downstream side of an airflow inside the intake path. Accordingly, favorable atomization of fuel inside the airflow is not reliably maintained throughout operation.

SUMMARY OF THE INVENTION

The present invention overcomes the shortcomings associated with the prior art and achieves other advantages not realized by the prior art.

An object of the present invention is to promote more reliable and effective fuel atomization.

An object of the present invention is to utilize the improved fuel atomization of the present fuel supply system in order to reduce fuel consumption, improve exhaust quality and improve engine output.

A further object of the present invention is to avoid increasing ventilation resistance and thereby significantly improve engine output.

A further object of the present invention is to prevent fuel from sticking to the inner surface of fuel system intake paths.

A further object of the present invention is to more effectively atomize fuel by causing fuel streams from opposite fuel induction ports to collide and combine with each other.

These and other objects are accomplished by an engine fuel supply system an engine fuel supply system comprising a fuel injection valve fitted in an intake path organizer, said intake path organizer forming an intake path communicating with an air cleaner, wherein said intake path organizer further includes a fuel passage for guiding fuel from the fuel injection valve, said fuel passage including an annular groove surrounding said intake path, at least one fuel induction port each having a first end communicating with the annular groove and a second end communicating directly with the intake path, and an air bleed passageway having a first end communicating with the intake path in a position further upstream with respect to said intake path than each fuel induction port and a second end communicating with the fuel passage; and wherein said second end of each fuel induction port is opened to the intake path in a direction orthogonal to an airflow in the intake path.

These and other objects are further accomplished by an engine fuel supply system comprising a fuel injection valve fitted in an intake path organizer, said intake path organizer forming an intake path communicating with an air cleaner, and wherein said intake path organizer further includes a fuel passage for guiding fuel from the fuel injection valve, said fuel passage including an annular groove surrounding said intake path, at least one fuel induction port having a first end communicating with the annular groove and a second end communicating directly with the intake path, and an air bleed passageway having a first end communicating with the intake path in a position further upstream with respect to said intake path than each fuel induction port and a second end communicating with the fuel passage; and wherein a narrowed section constituting part of the intake path is provided in the intake path organizer, said narrowed section having a smaller internal diameter than the intake path at a position on the upstream side of the narrowed section, and the second end of each fuel induction port opens to an inner surface of the narrowed section in a direction orthogonal to an air flow circulating in the narrowed section.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinafter and the accompanying drawings which are given by way of illustration only, and thus are not limiting of the present invention, and wherein.

DETAILED DESCRIPTION OF THE PREFERRED EMBODIMENTS

Embodiments of the present invention will now be described in the following with reference to the attached drawings.

Figure 1:
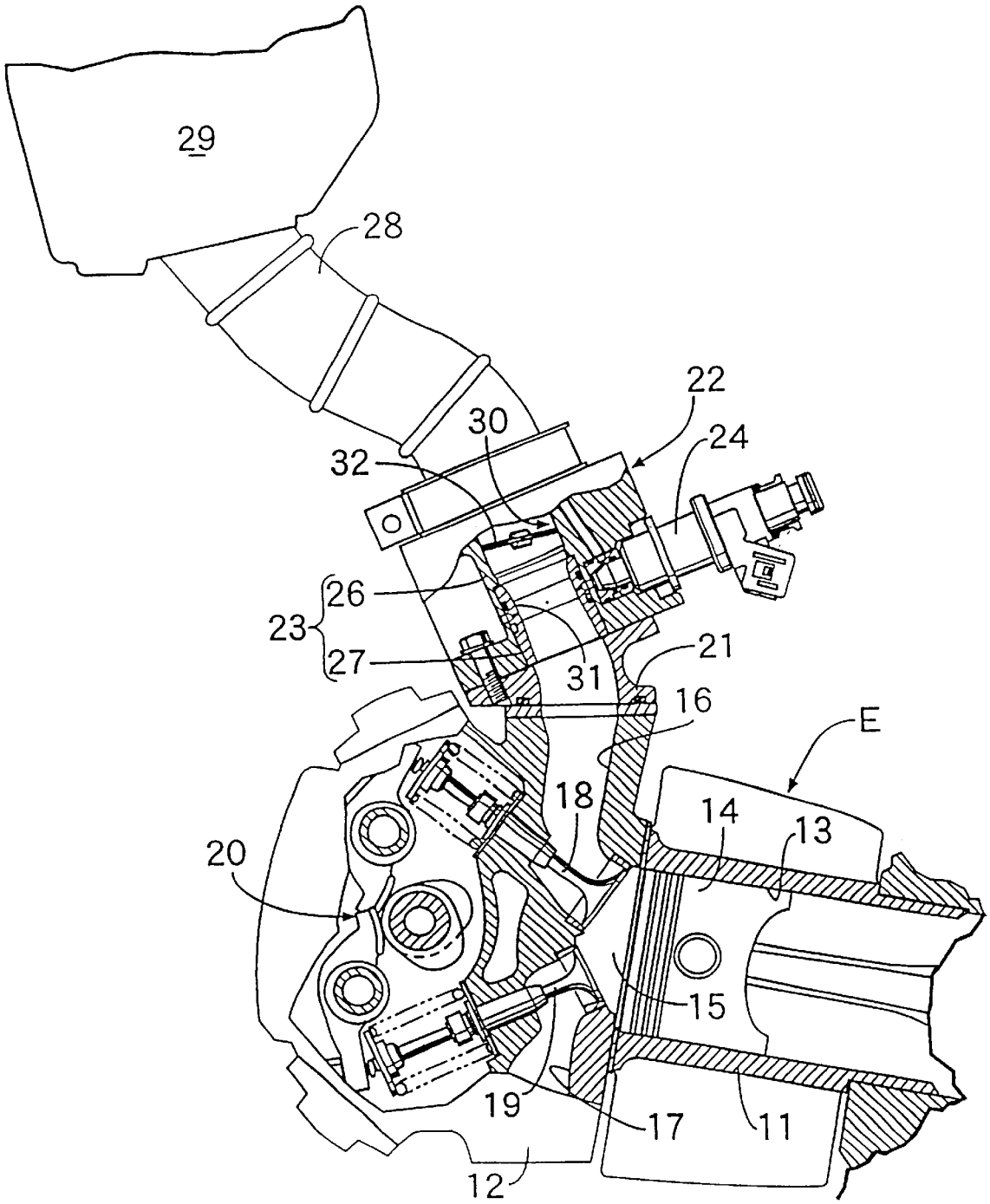
FIG. 1 is a cut-away cross sectional view showing an engine intake system according to an embodiment of the present invention.
Figure 2:
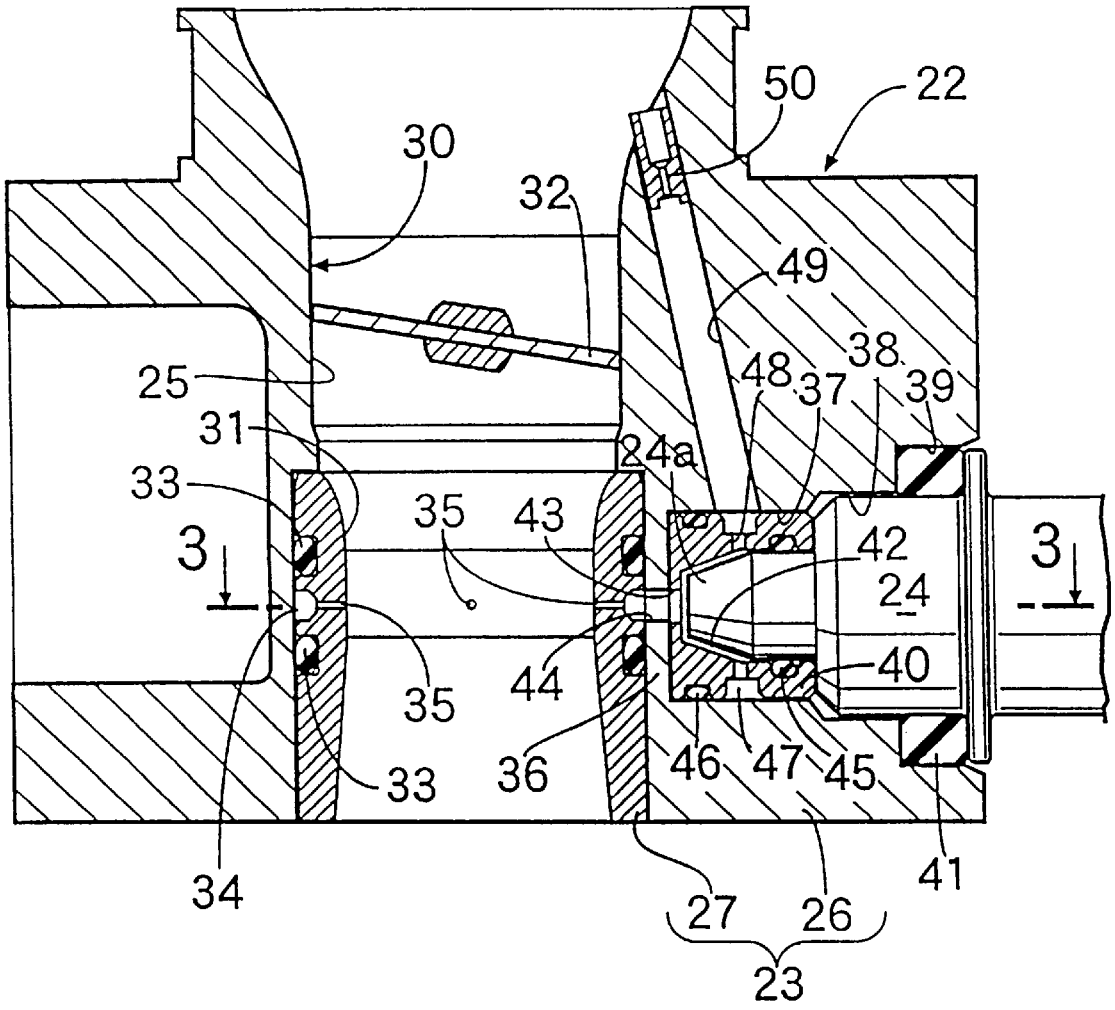
FIG. 2 is an enlarged vertical cross sectional view of an intake path organizer according to an embodiment of the present invention.
Figure 3:
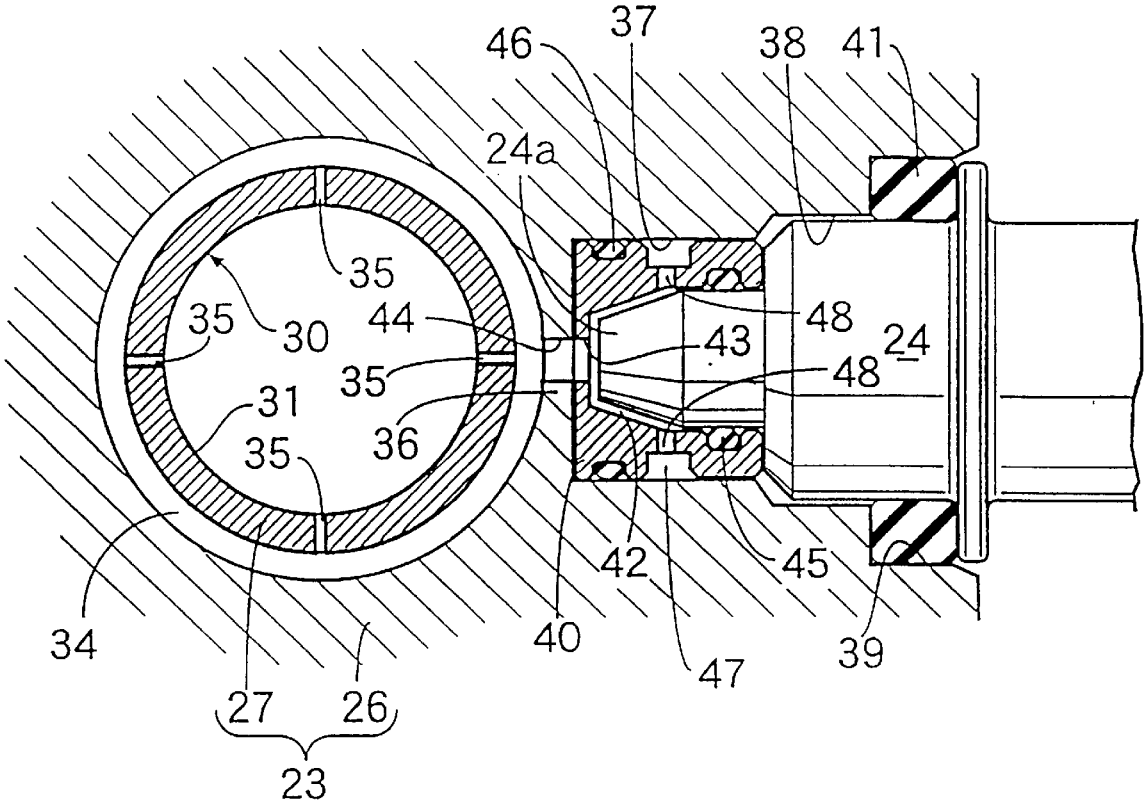
FIG. 3 is a cross sectional view taken along line 3—3 in FIG. 2.
Figure 4:
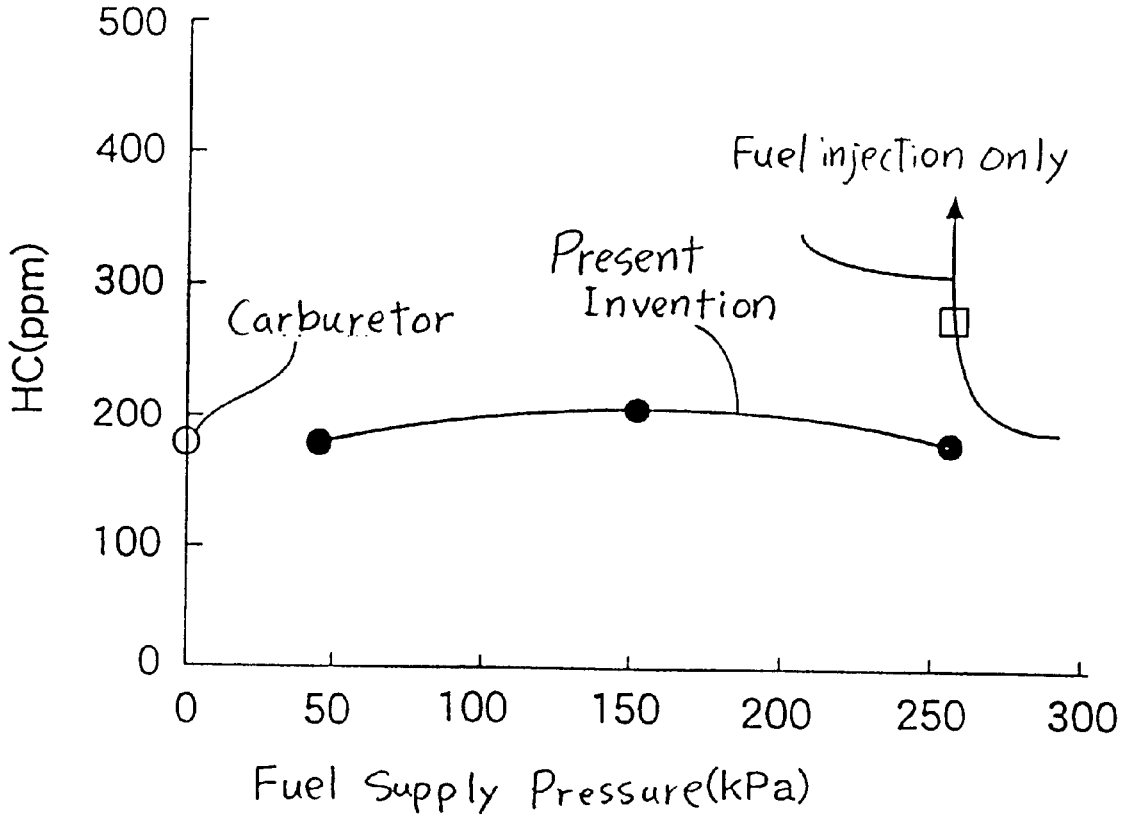
FIG. 4 is a graphical view showing a relationship between fuel supply pressure and exhaust quality.
Figure 5:
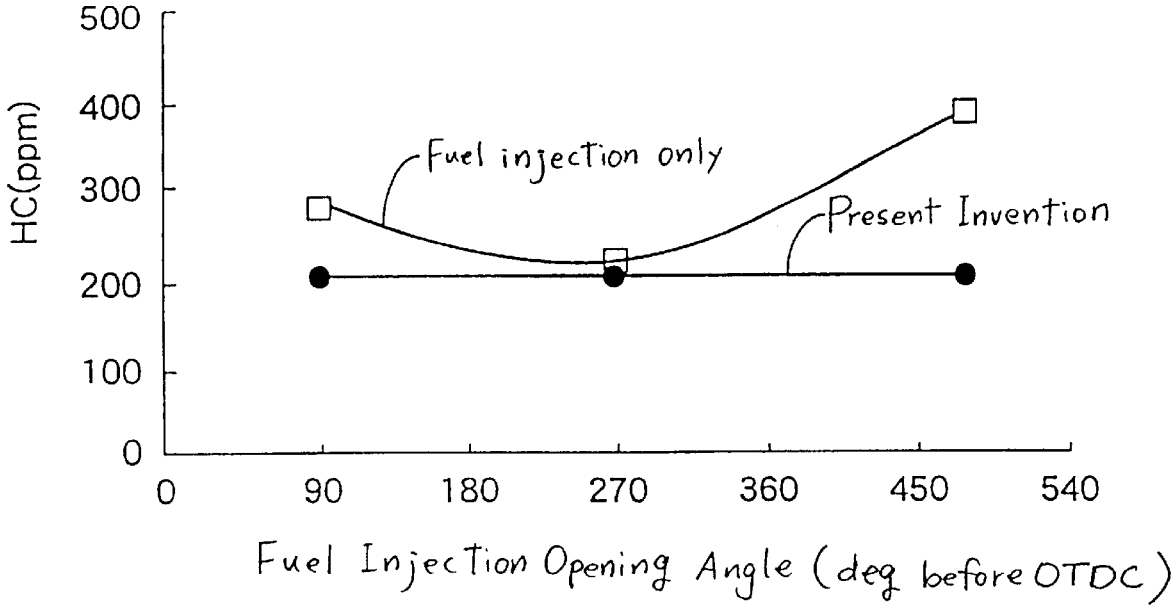
FIG. 5 is a graphical view showing a relationship between fuel injection timing and exhaust quality.
Figure 6:
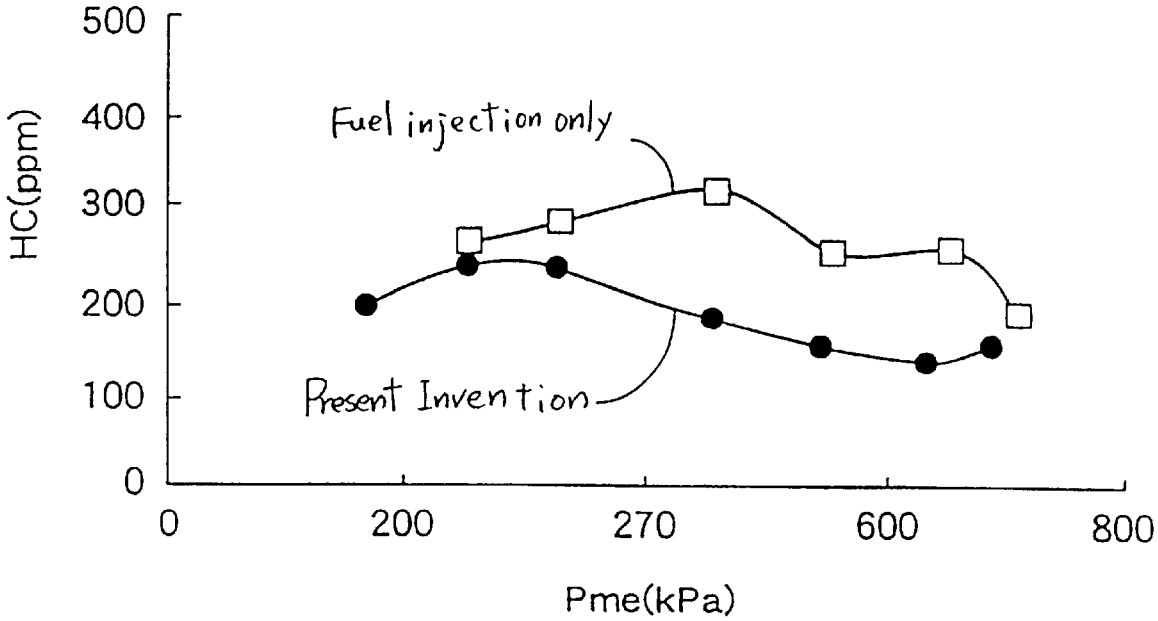
FIG. 6 is a graphical view showing a relationship between brake-mean effective pressure and exhaust quality.

A first embodiment of the present invention is shown in FIG. 1–FIG. 6. FIG. 1 is a cut-away cross sectional view showing an engine intake system according to an embodiment of the present invention, FIG. 2 is an enlarged vertical cross sectional view of an intake path organizer according to an embodiment of the present invention, FIG. 3 is a cross sectional view taken along line 3—3 in FIG. 2, FIG. 4 is a graphical view showing a relationship between fuel supply pressure and exhaust quality, FIG. 5 is a graphical view showing a relationship between fuel injection timing and exhaust quality, and FIG. 6 is a graphical view showing a relationship between brake-mean effective pressure and exhaust quality;.

In FIG. 1, an engine E comprises a cylinder block 11 and a cylinder head 12 joined to the cylinder block 11. A combustion chamber 15 is formed between a piston 14 slidably fitted in a cylinder bore 13 and the cylinder block 11 and the cylinder head 12.

An intake port 16 and an exhaust port 17 capable of communicating with the combustion chamber are provided in the cylinder head 12, an intake valve 18 for switching between communication and disconnection between the intake port 16 and the combustion chamber, and an exhaust valve 17 for switching between communication and disconnection between the exhaust port and the combustion chamber, are supported in the cylinder head 12 so as to enable opening and closing operations during respective intake and exhaust cycles. The intake valve 18 and the exhaust valve 19 are opened and closed by a conventional valve mechanism 20.

A fuel supply system 22 is connected to the intake port 16 via an intake pipe 21. This fuel supply system 22 comprises an intake path organizer 23 and a fuel injection valve 24 mounted in the intake path organizer 23.

In FIG. 2, the intake path organizer 23 is comprised of an intake path main component 26 having a passageway 25, and a narrowed section 27 fixed to the intake path main component 26 by fitting into a downstream side of the passageway 25. The intake path main component 23 includes an intake path 30 that has an upper end communicating with an air cleaner 29 via an intake hose 28, and a lower end communicating with the intake pipe 21. The intake path 30 is comprised of a portion permitting the removal of sections, to which the narrowing member 27 in the passageway 25 is fitted, and a narrowed section 31 formed at an inner surface of the narrowing member 27. The narrowed section 31 is formed having a smaller internal diameter than the intake path 30 positioned further upstream than the narrowed section 31, i.e. smaller than the passageway 25.

A butterfly type throttle valve 32 for controlling the opening extent of the intake path 30 is rotatably supported in the intake path main component 26 of the intake path organizer 23 further upstream than the narrowed section 31.

With reference to FIG. 2 and FIG. 3, an annular groove is provided around the outer periphery of the narrowing member 27, and a pair of annular seal members 33, 33 are fitted sandwiching the annular groove. The narrowing member 27 is fitted into the intake path main component 26, and an annular fuel passage 34 is formed in a fixed state between the narrowing member 27 and the intake path main component 26 using the annular groove, with both sides of the fuel passageway 34 being sealed by the seal members 33, 33 interposed between the intake path main component 26 and the narrowing member 27. Specifically, an annular fuel passageway 34 concentrically surrounding the intake path 30 is provided in the intake path organizer 23 at sections corresponding to the narrowed section 31.

A plurality of, for example four, fuel induction ports 35, 35 each having one end leading to the fuel passage 34 and an other end opening to an inner surface of the narrowed section 31 are provided so that the other end opening sections of respective fuel induction ports 35, 35 are opposite to each other. Also, each of the fuel induction ports 35, 35 is arranged in a plane orthogonal to the axis of the narrowed section 31. The other ends of each of the fuel induction ports 35, 35 are open to an inner surface of the narrowed section 31 in a direction orthogonal to a flow direction of air circulating in the narrowed section 31.

A small diameter hole 37 having an end wall 36 at an inner end, an intermediate diameter hole 38 having a larger diameter than the small diameter hole 37 and with an inner end leading coaxially to an outer end of the small diameter hole 37, and a large diameter hole 39 having a larger diameter than the intermediate diameter hole 38 and an inner end leading coaxially to an outer end of the intermediate hole 38. The large diameter hole has an opening outer end provided in the intake path main component 26 of the intake path organizer 23. A cylindrical collar 40 having a closed inner end and an outer end is fitted into the small diameter hole 37.

The tip of the fuel injection valve 24 is inserted into the intermediate diameter hole 38 and the large diameter hole 39 with an annular seal member 41 interposed between the large diameter hole 39 and the fuel injection valve 24. A cylindrical fuel injection nozzle 24*a* provided at an extreme end of the fuel injection valve 24 is fitted into the collar 40.

A bleed chamber 42 is formed between the fuel injection nozzle 24a and the collar 40. The bleed chamber 42 communicates with the fuel passage 34 through an axial communicating hole 43 provided in a tip blocking section of the collar 40 and a second axial communicating hole 44 provided in the end wall 36 coaxially with the communicating hole 43. An annular seal member 45 is interposed between an outer end of the collar 40 and the fuel injection nozzle 24*a,* and an annular sealing member 46 for pressing against the inner surface of the small diameter hole is fitted onto the outer surface of the inner end of the collar 40.

An annular recess is provided in an outer surface of a middle part of the collar 40 for forming an annular chamber 47 between the inner surface of the small diameter hole 37 and the collar 40. A plurality of communicating holes 48, 48 communicating between the annular chamber 47 and the bleed chamber 42 are also provided in the collar 40.

An air bleed passage 49 having one end leading to the intake path 30 at a point further upstream than each of the fuel induction ports 35, 35 and further upstream than the throttle valve 32 in this embodiment, is provided in the fuel path main component member 26 of the fuel path organizer 23. The other end of the air bleed passage 49 leads to the annular chamber 47, and an air jet 50 is press-fitted into one of the ends of this air bleed passage 49. Specifically, the air bleed passage 49 has one end communicating with the intake path 30 upstream of the throttle valve 32 and the other end communicating with the fuel passage 34 through the annular chamber 47, the communicating holes 48, 48, the bleed chamber 42 and the axial communicating holes 43 and 44.

Operation of this first embodiment will now be described with reference to the accompanying drawings. Fuel is injected from the fuel injection valve 24 inside the bleed chamber 42. The fuel is metered and mixed by the air jet 50, and mixed with assist air supplied from the air bleed passage 49 and guided to the fuel passage 34. The fuel is then sucked from the fuel induction ports 35, 35 to the intake path 30 by the airflow circulating in the intake path 30 and is thereby atomized. Since each of the fuel induction ports 35, 35 opens to the intake path 30 in a direction orthogonal to the air flow circulating in the intake path 30, the fuel is effectively atomized because of collision between the air flow circulating in the intake path 30 and the fuel sucked into the air flow from the fuel induction holes 35, 35. This arrangement promotes efficient and reliable fuel atomization, which therefore makes it possible to reduce fuel consumption and enables improvement in exhaust quality and engine output.

Since each of the fuel induction holes 35, 35 is open to the inner surface of the intake path 30, the airflow inside the intake path 30 is not disturbed by any structure normally provided in the related art. Accordingly, it is possible to avoid any unnecessary increases in the ventilation resistance of the intake path, and it is therefore possible to significantly improve engine output.

The fuel induction ports 35, 35 open to an inner surface of the intake path 30 at positions opposite to each other. This causes the fuel streams from each fuel induction port 35 to collide in the intake path 30 with adjacent and opposite fuel streams. By causing collisions between respective fuel streams sucked into the air flow side from the mutually opposite fuel induction holes 35, 35, the fuel is prevented from sticking to the inner surface of the intake path 30. This arrangement makes it possible to significantly reduce fuel consumption and to improve exhaust quality and engine output.

In particular, the narrowed section 31 constituting part of the intake path 30 is provided in the intake path organizer 23 having an internal diameter smaller than the intake path 30 further upstream. The fuel induction holes 35, 35 open to an inner surface of the narrowed section 31 in directions orthogonal to air flow circulating in the narrowed section 31, which means that it becomes possible to more effectively suck fuel from the fuel induction holes 35, 35 to the air flow side using negative intake pressure at the narrowed section 31. This combination of structural arrangements makes it possible to further significantly reduce fuel consumption and further possible to improve exhaust quality and engine output.

In FIG. 4, exhaust quality of the fuel supply system 22 of the present invention and exhaust quality of a fuel supply system using only fuel injection from a fuel injection valve are compared with variations in fuel supply pressure under running conditions of engine speed of 4000 rpm and brake mean effective pressure $P_{me}$ of 400 kPa. With the fuel supply system 22 using only fuel injected from a fuel injection valve, fuel supply pressure has a lower limit threshold of 250 kPa.

In contrast, the fuel supply system 22 of the present invention can produce fuel sprays which can suppress hydrocarbon (HC) concentration in the exhaust gas limited to about 180 ppm. This achieves results which are about the same as a conventional carburetor, even if the fuel supply pressure to the fuel injection valve is reduced to 0 kPa. As aforementioned, sufficient atomization of the fuel is not obtained with the fuel supply system of the related art using only fuel injection from a fuel injection valve unless the fuel supply pressure is set to at least 250 kPa. However, the fuel supply system 22 of the present invention makes it possible to sufficiently atomize fuel even if the fuel supply pressure is reduced to almost 0 kPa.

Accordingly, it is possible to make a fuel pump connected to the fuel injection valve 24 relatively small in size, and to thereby significantly reduce power consumption. Consequently, it is also possible to reduce the cost of unnecessary fuel piping provided between the fuel injection valve 24 and the fuel pump. Instead of using the fuel pump, it is also possible to supply fuel to the fuel injection valve 24 using only head pressure from a fuel tank arranged above the fuel injection valve 24 and to meter fuel by simply switching the fuel injection valve 24 on and off.

Since it is possible to perform adequate fuel atomization in the aforementioned manner, it becomes possible to shorten the length of an intake pipe from the fuel passage organizer 22 to the intake port 16, and it is possible to reduce the overall size of an engine, particularly the intake system.

In addition, the fuel injection valve 24 can be fitted into the intake path organizer 23 with any orientation that still permits fuel supply to the fuel passage 34. This further increases the degree of freedom for the designer with respect to the design of the fuel injection valve 24 and the supporting structure. The fuel injection valve 24 is fitted so that it is orthogonal to the intake path 30 in this embodiment, that permits a significant reduction in the overall size of the engine, including the intake system achieved by reducing the length of the intake system.

FIG. 5 shows a comparison of exhaust quality of the fuel supply system 22 of the present invention and exhaust quality of a fuel supply system using only fuel injected from a fuel injection valve under running conditions of engine speed of 4000 rpm and brake mean effective pressure $P_{me}$ of 400 kPa with variation in fuel injection timing (crank angle before OTDC). As is clear from FIG. 5, there is no variation in exhaust quality with the fuel supply system 22 of the present invention even if the injection timing of the fuel injection valve 24 is varied.

However, the exhaust quality significantly varies according to variations in injection timing with the fuel supply system 22 of the related art using only fuel injection from a fuel injection valve. Specifically, with the fuel supply system 22 of the present invention, fuel is metered using intake negative pressure according to running conditions of the engine E and sucked into the intake path 30, and the fuel injection valve 24 preferably supplies fuel according to the amount of fuel sucked into the intake path 30. This makes it possible to sufficiently atomize the fuel and obtain improved exhaust quality without having to control injection timing of the fuel injection valve 24 with high precision. However, with the fuel supply system of the related art using only fuel injection from a fuel injection valve, adequate fuel atomization is not obtained unless the fuel injection timing is controlled with high precision and exhaust quality is bad.

FIG. 6 shows a comparison of exhaust quality of the fuel supply system 22 of the present invention and exhaust quality of a fuel supply system of the relate art using only fuel injection from a fuel injection valve under low engine running conditions of 2000 rpm with variations in brake mean effective pressure $P_{me}$. As is clear from FIG. 6, with the fuel supply system 22 of the present invention, when brake mean effective pressure $P_{me}$ is low, namely when the engine is running at a low speed of 2000 rpm or at high load, fuel is sufficiently atomized and good exhaust quality is obtained. However, the fuel system of the related art using only fuel injection from a fuel injection valve cannot sufficiently atomize the fuel leading to degradation of exhaust quality. Specifically, with the fuel supply system 22 of the present invention atomization is also carried out using assist air, which means that it is possible to sufficiently atomize the fuel even under high load, low speed running conditions.

In a conventional engine in which fuel is supplied using a single fuel injection valve, it is difficult to handle fuel supply over a wide driving range from idle opening of the throttle valve to fully open, with a single fuel injection valve. Therefore, an additional fuel injection valve is necessary and is therefore arranged upstream of the throttle valve. However, the fuel supply system of the present invention can replace complicated and expensive systems utilizing the additional fuel injection valve.

Figure 7:
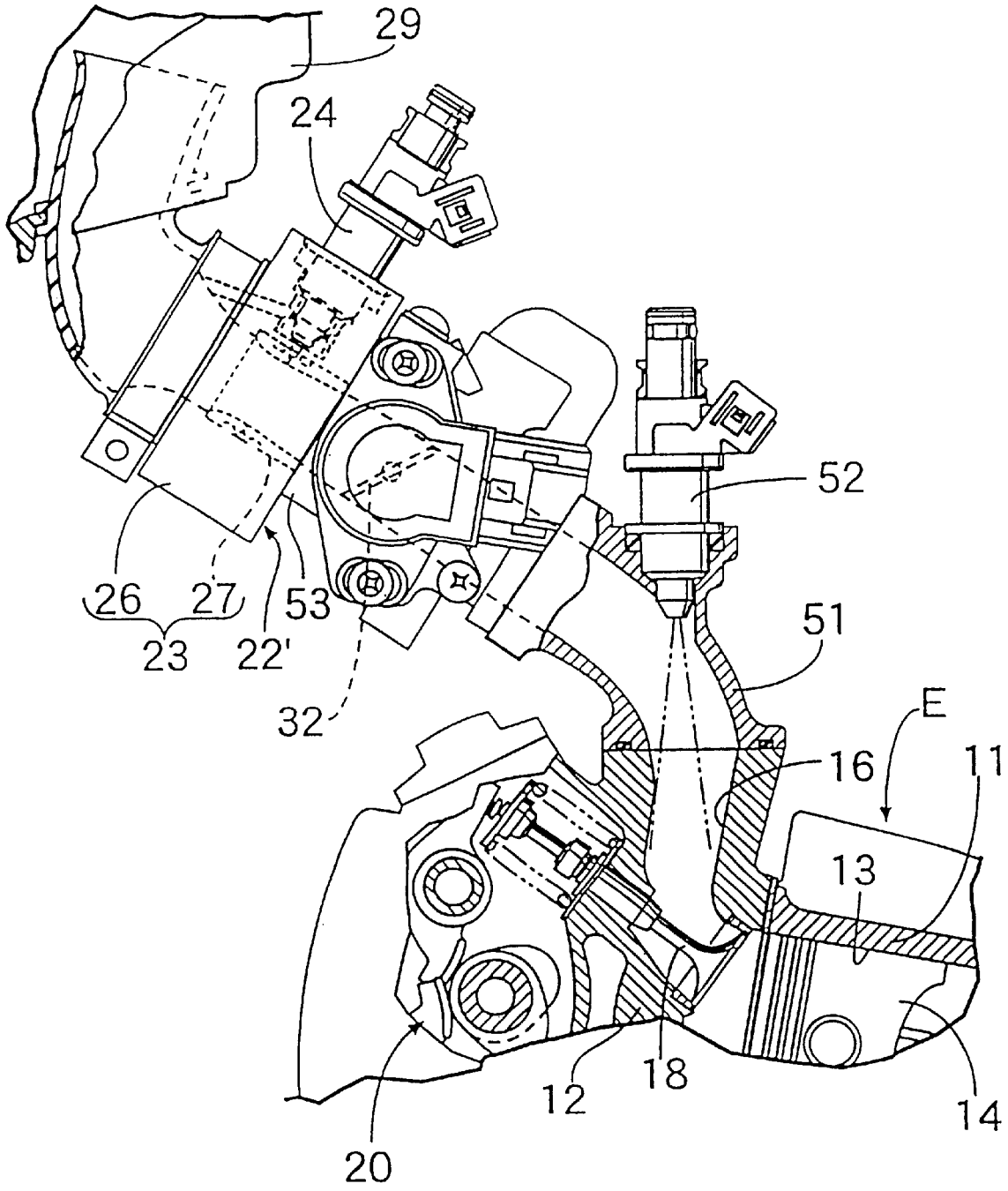
FIG. 7 is a cross sectional view of an engine intake system according to an embodiment of the present invention.

The intake system in this type of situation will now be described in a second embodiment. In FIG. 7, a fuel injection valve 52 for mainly handling fuel to be supplied to an engine E is attached to an intake pipe 53 connected to an intake port 16 of the engine E, and the intake pipe is connected to an air cleaner 29 through a throttle body provided with a throttle valve, and a fuel supply system 22'.

The fuel supply system 22' has the same structure as the fuel supply system 22 of the first embodiment described above except for the fact that the throttle valve 32 (shown in dashed lines) is not provided, and supplements fuel when an amount of fuel injected from the fuel injection valve 52 is insufficient.

According to the second embodiment, it is possible to avoid increasing intake resistance due to the fuel supply system 22' regardless of the fact that the fuel system 22' is arranged upstream of the throttle valve 32 in place of the additional fuel injection valve.

Figure 8:
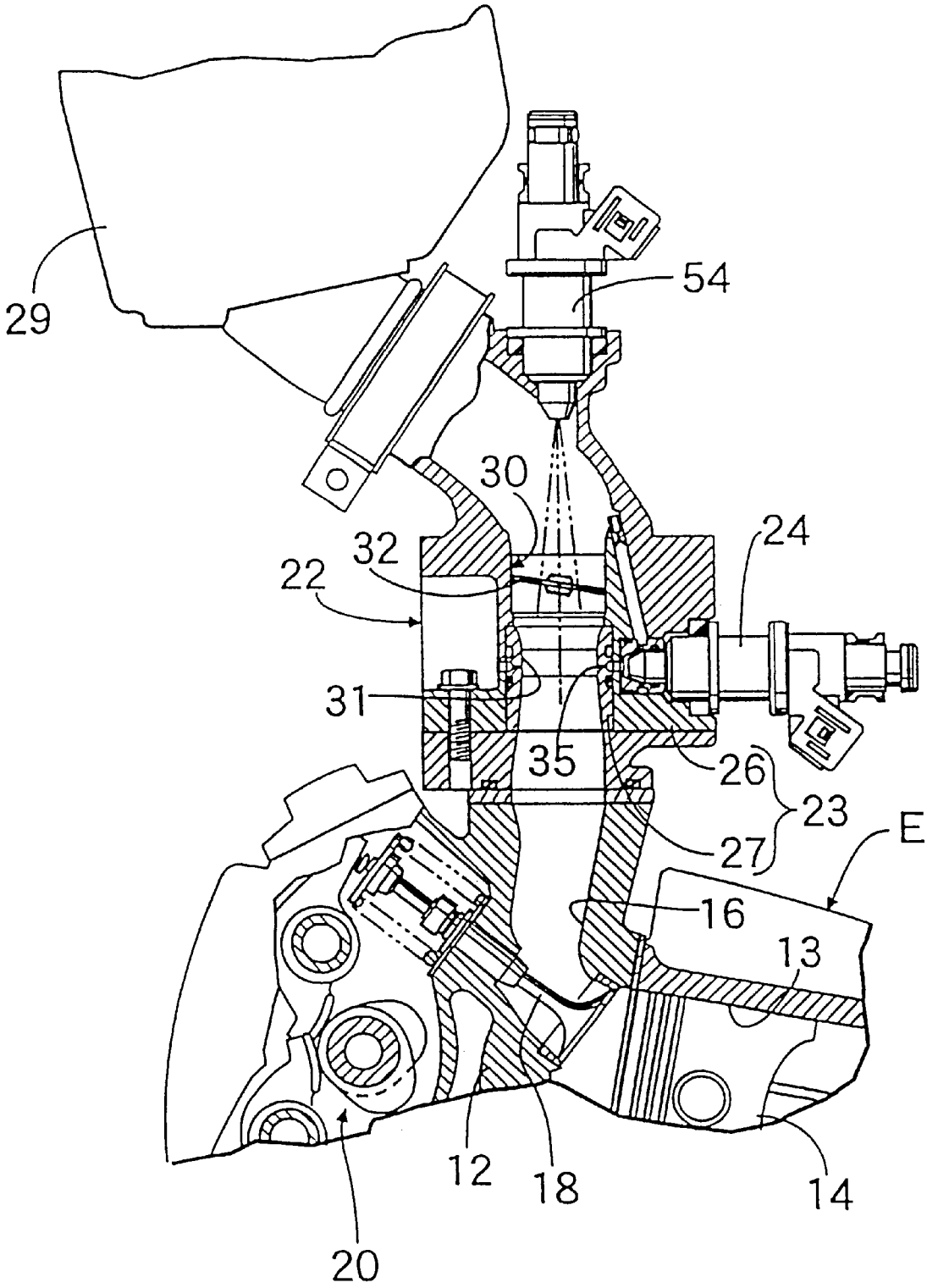
FIG. 8 is a cross sectional view of an engine intake system according to an embodiment of the present invention.

FIG. 8 shows a third embodiment of the present invention. A fuel injection system with a throttle valve 32 is connected to an intake port 16 of an engine mainly responsible for supply of fuel to the engine E, and an additional fuel injection valve 54 is attached between the throttle valve 32 and the air cleaner 29.

The injection direction of the additional fuel injection valve 54 is set to a direction coincident with a central axis of the narrowed section 31 of the fuel supply system.

According to the third embodiment, in the fuel supply system 22 fiuel is injected from the additional fuel injection valve 54 towards fuel sucked into the air flow from the respective fuel induction ports 35 at the inside of the narrowed section 31. Therefore, it is possible to make the concentration of air-fuel mixture uniform when the throttle valve 32 is fully open.

Figure 9:
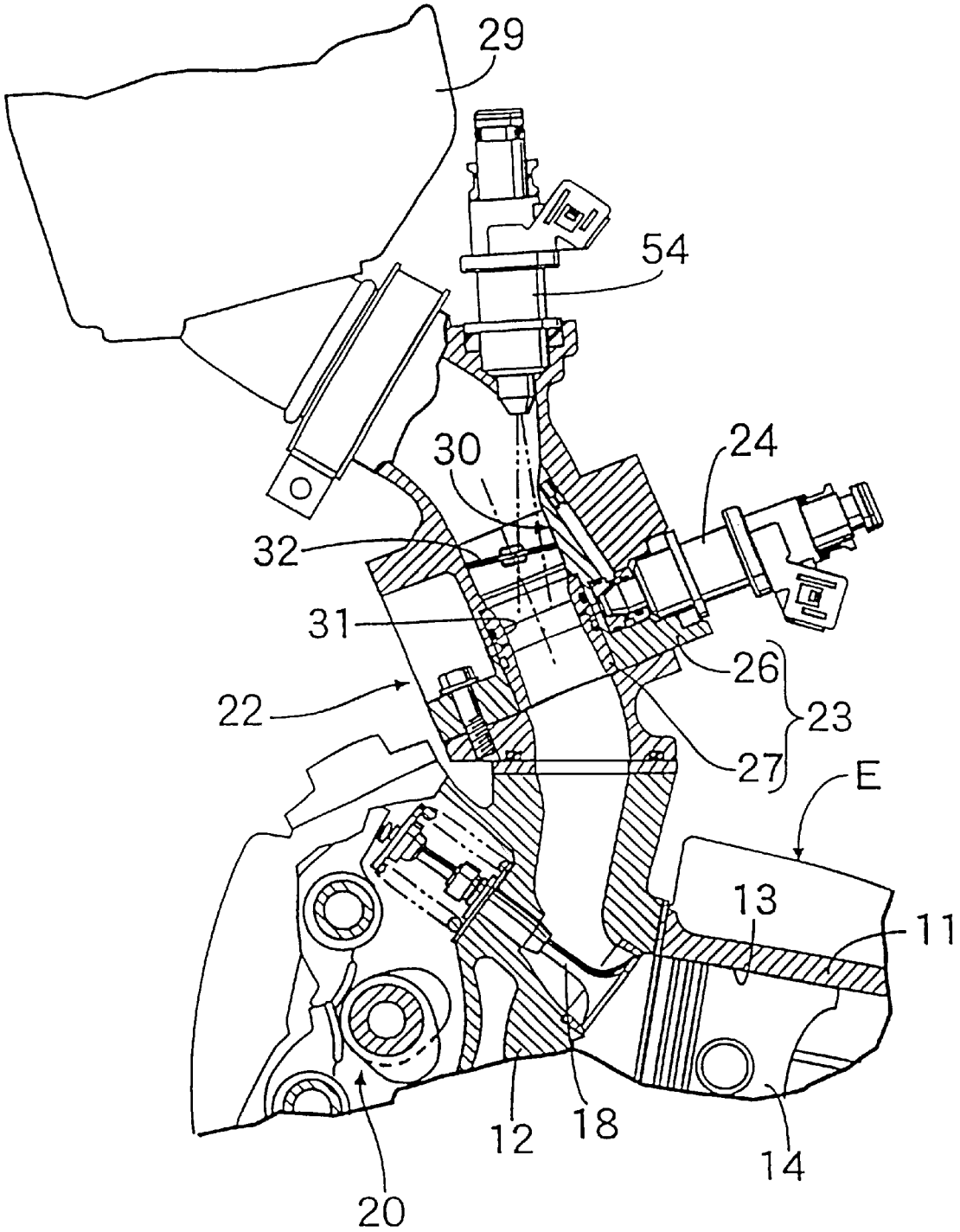
FIG. 9 is a cross sectional view of an engine intake system according to an embodiment of the present invention.

FIG. 9 shows a fourth embodiment of the present invention. While in the third embodiment the injection direction of the additional fuel injection valve 54 is set to a direction coincident with a central axis of the narrowed section 31 of the fuel supply system, in the fourth embodiment the injection direction of the additional fuel injection valve 54 is set so as to pass through the center of a section where the fuel induction ports 35 are provided in the narrowed section 31.

According to the fourth embodiment, fuel injected from the additional fuel injection valve 54 is positioned to collide with fuel sucked from the fuel induction ports 35 without being obstructed by the fully open throttle valve 32 and is therefore more effectively dispersed. Accordingly, it is possible to make the air-fuel mixture concentration extremely uniform.

According to the invention as disclosed hereinabove, the airflow of the intake path and fuel sucked into the air flow side from the fuel induction port, efficiently collide with each other making it possible to effectively atomize the fuel. Accordingly, it becomes possible to reduce fuel consumption and it also becomes possible to improve exhaust quality and engine output.

According to the invention as disclosed hereinabove, it is also possible to avoid increasing ventilation resistance, thereby significantly improving engine output.

According to the combinations and arrangements of the present invention disclosed hereinabove, it is possible to prevent fuel from sticking to the inner surface of the intake path and to much more effectively atomize fuel by causing fuel streams sucked from mutually opposite fuel induction ports into the airflow side to collide with each other. This arrangement significantly reduces fuel consumption and makes it further possible to significantly improve exhaust quality and engine output.

According to another aspect of the present invention, it becomes possible to effectively suck fuel from the fuel induction port into the airflow side using negative intake pressure at a narrowed section of the intake path. It then becomes possible to more effectively atomize fuel by causing the airflow of the narrowed section and fuel sucked into the intake path to collide with each other. These arrangements make it possible to reduce fuel consumption and further possible to improve exhaust quality and engine output.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. An engine fuel supply system comprising:

a fuel injection valve fitted in an intake path organizer, said intake path organizer forming an intake path communicating with an air cleaner, wherein said intake path organizer further includes a fuel passage for guiding fuel from the fuel injection valve, said fuel passage including an annular groove surrounding said intake path, at least one fuel induction port each having a first end communicating with the annular groove and a second end communicating directly with the intake path, and an air bleed passageway having a first end communicating with the intake path in a position further upstream with respect to said intake path than each fuel induction port and a second end communicating with the fuel passage; and wherein said second end of each fuel induction port is opened to the intake path in a direction orthogonal to an airflow in the intake path.

2. The engine fuel supply system according to claim 1, wherein each fuel induction port is provided in the intake path organizer and opens to an inner surface of the intake path organizer.

3. The engine fuel supply system according to claim 2, wherein each second end of a plurality of fuel induction ports opens to an inner surface of the intake path organizer at positions opposite to a respective fuel induction port.

4. The engine fuel supply system according to claim 1, wherein a butterfly type throttle valve for controlling an opening of the intake path is rotatably supported in an intake path main component of the intake path organizer.

5. The engine fuel supply system according to claim 1, wherein said intake path organizer further comprises an intake path main component having a small diameter hole at an inner end of said intake path main component, an intermediate diameter hole having a larger diameter than said small diameter hole and with an inner end leading coaxially to an outer end of said small diameter hole, and a large diameter hole having a larger diameter than said intermediate diameter hole and with an inner end leading coaxially to an outer end of said intermediate hole.

6. The engine fuel supply system according to claim 5, wherein a cylindrical collar having a closed inner end is engaged with said small diameter hole.

7. The engine fuel supply system according to claim 6, wherein a cylindrical fuel injection nozzle on a tip of the fuel injection valve is inserted into said collar.

8. The engine fuel supply system according to claim 7, wherein said intake path organizer further comprises a bleed chamber formed between said fuel injection nozzle and said collar.

9. The engine fuel supply system according to claim 8, wherein said bleed chamber communicates with the fuel passage through a communicating hole provided in a tip blocking section of the collar and a second communicating hole coaxial with said communicating hole and provided in the end wall of the intake path main component.

10. The engine fuel supply system according to claim 9, wherein said intake path main component further comprises an annular seal member interposed between an outer end of said collar and the fuel injection nozzle, and an annular sealing member for sealing against an inner surface of the small diameter hole is engaged with an outer surface of the collar.

11. The engine fuel supply system according to claim 1, wherein said intake path organizer further comprises an intake path main component having a plurality of holes formed in an inner end of said intake path main component, and said fuel injection valve is positioned within said plurality of holes in a position orthogonal to said airflow in said intake path.

12. The engine fuel supply system according to claim 10, wherein a cylindrical collar having a closed inner end is engaged with said plurality of holes formed in said intake path main component and a cylindrical fuel injection nozzle on a tip of the fuel injection valve is inserted into said collar.

13. An engine fuel supply system comprising:

a fuel injection valve fitted in an intake path organizer, said intake path organizer forming an intake path communicating with an air cleaner, wherein said intake path organizer further includes a fuel passage for guiding fuel from the fuel injection valve, said fuel passage including an annular groove surrounding said intake path, at least one fuel induction port each having a first end communicating with the annular groove and a second end communicating directly with the intake path, an air bleed passageway having a first end communicating with the intake path in a position further upstream with respect to said intake path than each fuel induction port and a second end communicating with the fuel passage, said second end of each fuel induction port being opened to the intake path in a direction orthogonal to an airflow in the intake path;

an intake path main component of said intake path organizer having a small diameter hole at an inner end of said intake path main component, an intermediate diameter hole having a larger diameter than said small diameter hole and with an inner end leading coaxially to an outer end of said small diameter hole, and a large diameter hole having a larger diameter than said intermediate diameter hole and with an inner end leading coaxially to an outer end of said intermediate hole;

a cylindrical collar having a closed inner end being engaged with said small diameter hole;

a cylindrical fuel injection nozzle on a tip of the fuel injection valve insertable into said collar;

a bleed chamber formed between said fuel injection nozzle and said collar, wherein said bleed chamber communicates with the fuel passage through a communicating hole provided in a tip blocking section of the collar and a second communicating hole coaxial with said communicating hole and provided in the end wall of the intake path main component, and said air bleed passageway being connected with an annular chamber formed between an inner surface of said small diameter hole and the collar.

14. The engine fuel supply system according to claim 13, wherein an air jet is fitted in the first end of said air bleed passage.

15. The engine fuel supply system according to claim 13, wherein said intake path organizer further comprises a bleed chamber formed between said fuel injection nozzle and said collar.

16. An engine fuel supply system comprising:

a fuel injection valve fitted in an intake path organizer, said intake path organizer forming an intake path communicating with an air cleaner, and wherein said intake path organizer further includes a fuel passage for guiding fuel from the fuel injection valve, said fuel passage including an annular groove surrounding said intake path, at least one fuel induction port having a first end communicating with the annular groove and a second end communicating directly with the intake path, and an air bleed passageway having a first end communicating with the intake path in a position further upstream with respect to said intake path than each fuel induction port and a second end communicating with the fuel passage; and wherein a narrowed section constituting part of the intake path is provided in the intake path organizer, said narrowed section having a smaller internal diameter than the intake path at a position on the upstream side of the narrowed section, and the second end of each fuel induction port opens to an inner surface of the narrowed section in a direction orthogonal to an air flow circulating in the narrowed section.

17. The engine fuel supply system according to claim 16, wherein a butterfly type throttle valve for controlling an opening of the intake path is rotatably supported in an intake path main component of the intake path organizer and is located in a position in said airflow upstream of said narrowed section.

18. The engine fuel supply system according to claim 17, said annular groove being provided around an outer periphery of said narrowed section, and a pair of annular seal members sandwiching said annular groove.

* * * * *